United States Patent [19]

Reed

[11] 4,342,363

[45] Aug. 3, 1982

[54] GEOTHERMAL WELL HEAD

[75] Inventor: Lehman T. Reed, Bakersfield, Calif.

[73] Assignee: Midway Fishing Tool Company, Long Beach, Calif.

[21] Appl. No.: 203,407

[22] Filed: Nov. 3, 1980

[51] Int. Cl.[3] ..... E21B 33/03; E21B 34/02; E21B 34/16

[52] U.S. Cl. ..... 166/97; 166/95

[58] Field of Search ..... 166/75 R, 97, 95, 86, 166/85, 88

[56] References Cited

U.S. PATENT DOCUMENTS

| | | | |
|---|---|---|---|
| 1,911,905 | 5/1933 | Knowlton et al. | 166/95 X |
| 1,944,573 | 1/1934 | Raymond et al. | 166/95 X |
| 2,085,119 | 6/1937 | Penick et al. | 166/95 X |
| 2,118,094 | 5/1938 | McDonough et al. | 166/95 X |
| 2,134,044 | 10/1938 | Humason | 166/95 X |
| 2,830,666 | 4/1958 | Rhodes | 166/97 X |
| 3,186,488 | 6/1965 | Johnson et al. | 166/95 X |

*Primary Examiner*—Stephen J. Novosad
*Attorney, Agent, or Firm*—William C. Babcock

[57] ABSTRACT

A geothermal well head assembly that is so operatively associated with the production string of casing in a well bore that the string of casing may expand and contract longitudinally without placing any substantial strain on the assembly. The geothermal well head assembly is also of such structure that interior components thereof that may be damaged due to the abrasive action of high velocity pressurized geothermal fluid may be withdrawn from the assembly for maintenance or replacement without shutting down the geothermal well. Also the geothermal well head assembly is of such structure that it may be operated either manually or by pressurized fluid.

15 Claims, 12 Drawing Figures

FIG. 3
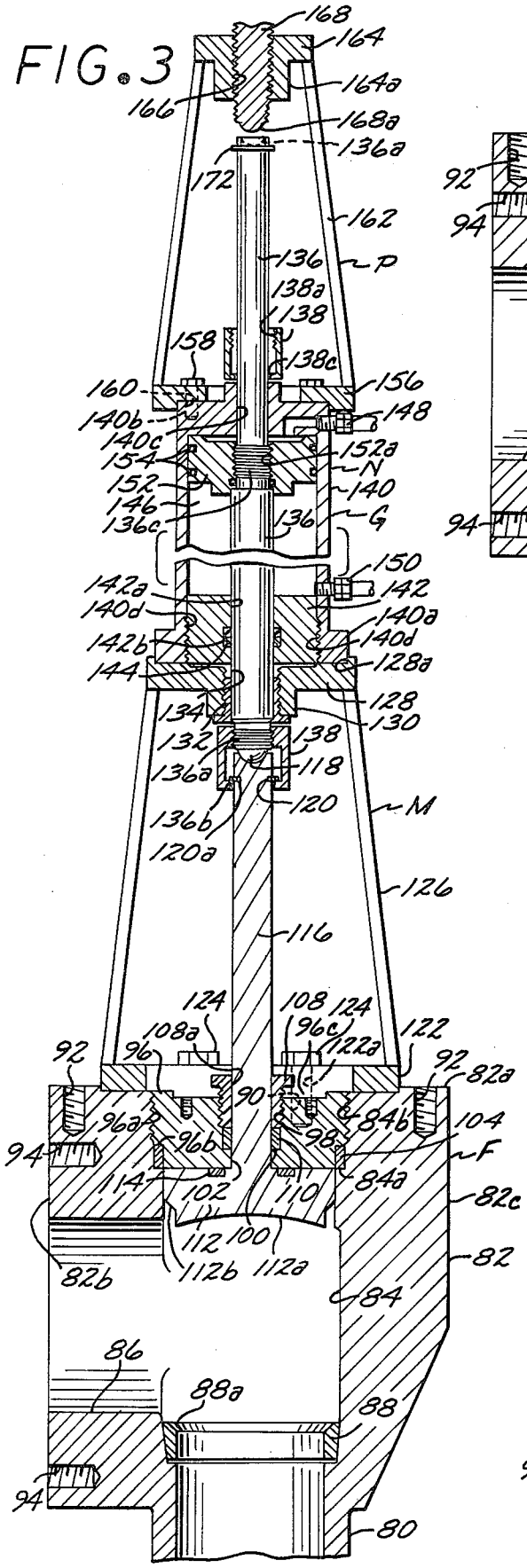
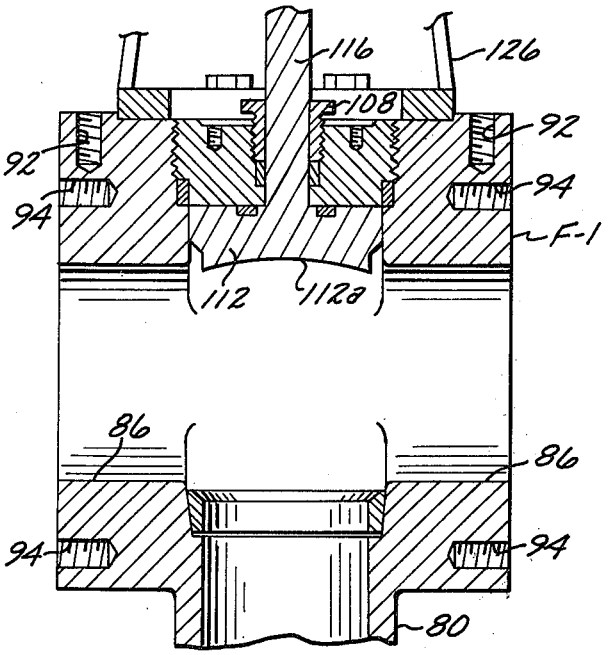
FIG. 4
FIG. 5
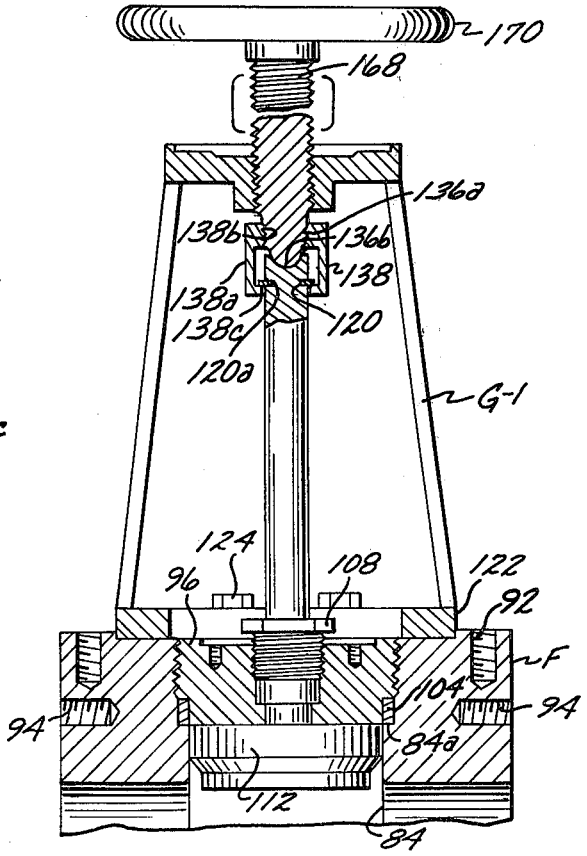

FIG. 9
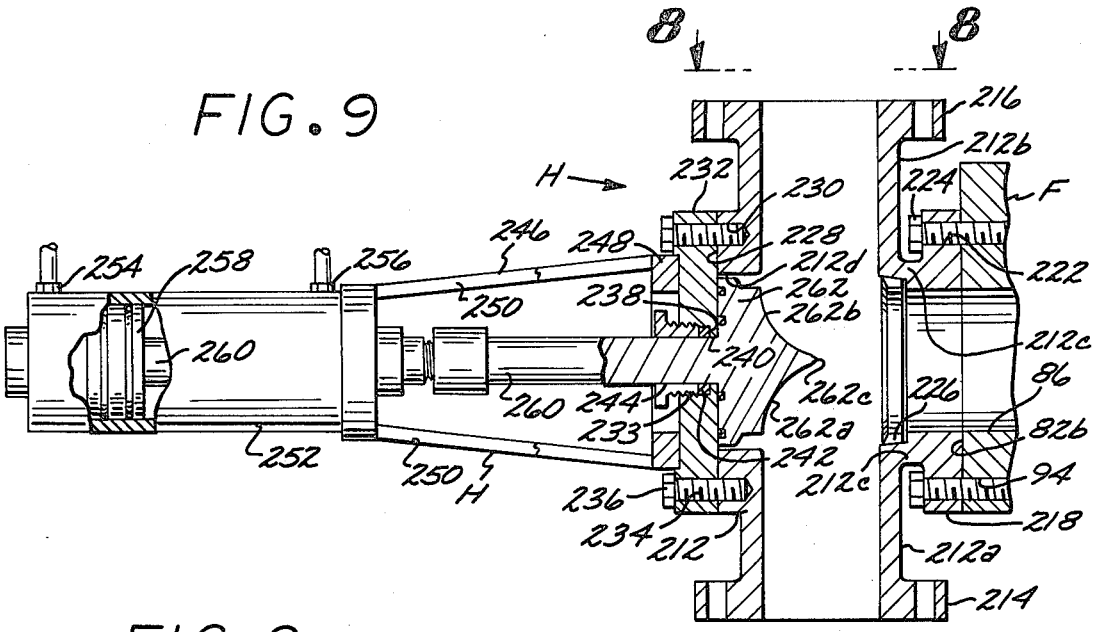
FIG. 8
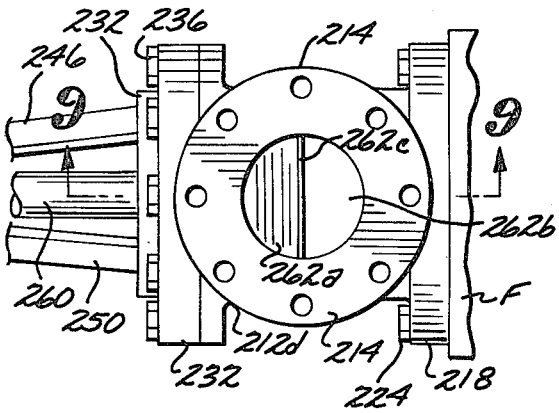
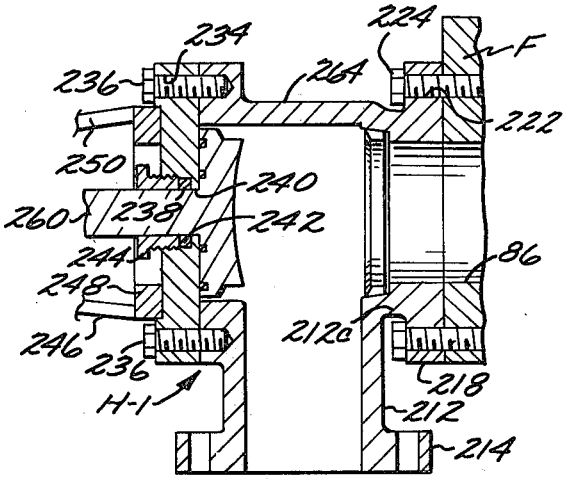
FIG. 10
FIG. 11
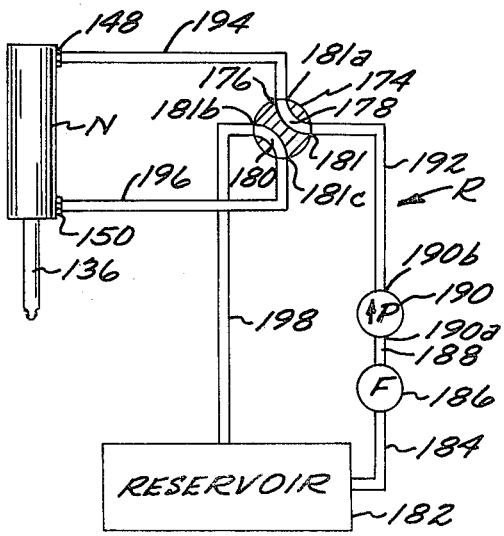
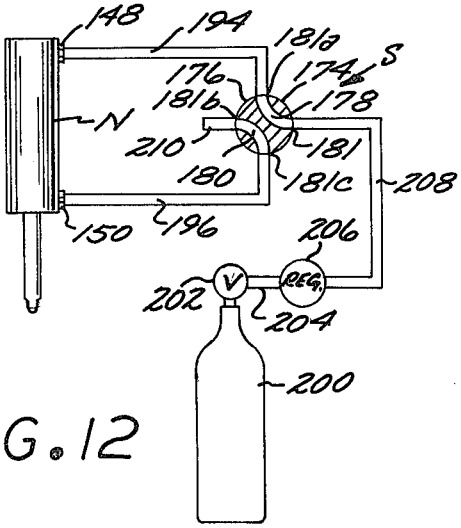
FIG. 12

GEOTHERMAL WELL HEAD

BACKGROUND OF THE INVENTION

1. Field of the Invention

Geothermal Well Head Assembly.

2. Description of the Prior Art

The drilling of geothermal wells to produce pressurized fluid for power generating purposes has developed only recently on a large scale in the United States. Such drilling and production has in the main been carried out by companies previously engaged in the production of petroleum.

Consequently, there has been a tendancy to employ the same well head equipment that was satisfactory for the production of oil to geothermal wells, but with unsatisfactory results. Operational difficulties encountered in adapting oil field well head equipment to geothermal wells involve the expansion and contraction of the string of production casing in the geothermal wells due to variations in temperature, and the failure of conventional oil well head assemblies to withstand for prolonged period of time the abrasive action of high velocity pressurized fluid having particles of solid material entrained therewith.

The replacement or repair of conventional oil well head assemblies that have been utilized on geothermal wells and been damaged for the reasons above stated, have in the past required that the geothermal wells be shut down by pumping mud into the bores thereof. This procedure is undesirable for a geothermal well that has been so shut down may be ruined, or the future production of pressurized fluid therefrom seriously impaired.

A major object of the present invention is to provide a well head assembly for use on geothermal wells that allows the string of production casing to expand and contract longitudinally in a bore hole without placing a substantial strain on the well head assembly, and one in which the seals between the production casing and well head assembly may be periodically adjusted from the ground surface without shutting down the well.

Another object of the invention is to furnish a geothermal well head assembly that may be operated either manually or by pressurized fluid, and one in which interior components that have been damaged by the abrasive action of the pressurized geothermal fluid may be removed for replacement or repair, without shutting down the geothermal well.

These and other objects and advantages of the invention will become apparent from the following description of a preferred form of the invention and certain alternate forms thereof.

SUMMARY OF THE INVENTION

The well head assembly of the present invention is operatively associated with a geothermal well bore for controlling the flow of pressurized fluid upwardly therethrough. The well head assembly is characterized by being of such structure that portions thereof subjected to the abrasive action of pressurized fluid may be removed from the assembly for maintenance work to be performed thereon without shutting down the geothermal well. The geothermal well bore has a surface string of casing cemented therein. The surface string of casing has a production string of casing of smaller diameter extending downwardly therethrough to the geothermal zone from which the pressurized fluid is produced. The production string of casing is illustrated in the drawings as having an upper end from which a circular rib projects outwardly that acts as a stop to support the production string of casing from the well head assembly prior to the production string of casing being cemented within the surface string of casing.

The well head assembly includes a tubular spool connected to the upper end of the surface string of casing, which spool has a first flange projecting outwardly from the upper end thereof, and the spool having a circular abutment on the interior. A substantially vertical tubular member is disposed within the spool and extends downwardly there below. A hanger is secured to the tubular member, with the hanger resting on the abutment within the spool.

The tubular member has an adapter secured to the lower end thereof, which adapter has an upper seal holder depending therefrom, which seal holder has a body shoulder defined on the interior thereof on which the rib of the string of production casing rests, and the body shoulder and rib cooperating to support the production string of casing in a depending position from the upper seal holder. The production string of casing is preferably allowed to be so supported for twenty-four hours or more prior to the production string of casing having cement injected into the annular space between it and the interior surface of the surface string of casing. This period of time allows the production string of casing to be uniformly heated by heat from the geothermal zone, and the production string of casing expanding longitudinally as a result thereof. After the string of production casing has been so heated and expanded, the cement is injected into the annular space. By following this procedure there is less tendency for the production string of casing to vary longitudinally in length to the extent that it separates from the cement between it and the surface string of tubing.

A first valve assembly is included as a part of the well head assembly, which valve assembly has a first valve body that has upper and lower ends and first and second side walls. A tubular neck depends downwardly from the lower end of the first valve body and terminates in a second bolt hole defining flange that is mounted on the first flange and secured thereto by bolts and nuts in a conventional manner.

The first valve body includes a first passage that extends upwardly through the second flange and tubular neck to the upper end of the valve body. The first passage has an upper portion that is threaded, and the first passage a substantial distance below the threaded portion defining a circular valve seat.

A second passage is provided in the first valve body that is transverse to the first passage and intersects the latter intermediate the valve seat and threaded upper portion, with the second passage extending outwardly through the first side wall. A threaded valve head removably engages the threaded upper portion of the first passage. A valve member is slidably disposed in the first passage, with the valve member capable of occupying either a first position where it seals with the valve seat or a second position where it is disposed above the second passage. An actuating rod is secured to the valve member and extends upwardly through a transverse bore in the head, with the actuating member serving to move the valve member to either the first or second positions. Pressurized fluid discharges from the first to the second passage when the valve member is in the second position.

The well head assembly also includes an actuator removably mounted on the upper end of the first valve body, which actuator may be either manually operated or operated by pressurized fluid, to dispose the valve member in either the first or second position. A production valve that is preferably operated by fluid under pressure is removably secured to the first side wall of the first valve body, and is in communication with the second passage. The production valve is utilized in controlling the flow of pressurized fluid from the well head assembly.

When it is desired to remove the valve member from the valve head assembly, the actuator is removed from the first valve body, and a rigid hollow member is extended downwardly over the actuator rod secured to the valve member, with the hollow member being removably secured to the head of the first valve body. A gate valve that has third and fourth flanges on the ends thereof, and a substantially vertical passage extending between the flanges, is mounted on the upper end of the first valve body, with the third flange removably secured to the second flange. The elongate hollow member extends upwardly through the vertical passage in the gate valve. The gate valve includes a transverse valve plate intermediately disposed between the third and fourth flanges that may be moved from a first to a second position. The valve plate when in the second position obstructs the vertical passage in the gate valve. The distance between the valve plate in the gate valve and the fourth flange is greater than the combined thicknesses of the valve body head and the valve member.

A working plate is removably secured to the fourth flange of the gate valve, with the working plate having a seal defining opening therein through which the hollow member extends upwardly. Manually operated means are disposed above the working plate for rotating the hollow member to unscrew the head from the first valve body and lift the hollow member, the head, the actuating rod, and the valve member attached to the latter to the extent that the head and valve member are disposed above the valve plate of the gate valve. The valve plate may be now moved from the first to a second position where it obstructs the vertical passage in the gate valve.

The working plate may now be disengaged from the fourth flange, and the actuating rod, head, and valve member separated therefrom to permit maintenance work to be performed thereon or have portions thereof replaced should the same be necessary. After the valve member has been replaced or repaired, the actuator rod is extended through the opening in the head, and this combination reinserted into the vertical passage in the gate valve above the valve plate, and with the hollow member secured to the head and extending around the actuator rod. The working plate is now secured to the fourth flange, with the valve plate now being moved to the first position, and the procedure previously described reversed to place and head in engagement with the first valve body. The working plate and hollow body may now be removed from the well head assembly and replaced by the actuator that engages the actuator rod associated with the valve member and used to move the latter between the first and second positions.

The production valve has a body in the form of a tubular cross that has first and second flanged ends, and a flanged leg of the cross being removably secured to the first side of the first valve body by bolts or the like. The tubular cross includes a fourth leg that movably supports a power operated rod that has a valve member mounted on the end thereof, which valve member is within the confines of the tubular cross and is adapted to be moved between a first position and a second position where it removably seals with a valve seat that forms a part of the cross.

The valve member has a pair of oppositely extending concave surfaces defined thereon, which deflect pressurized fluid discharging into the cross to divide the flow outwardly in equal amounts from the first and second ends thereof. The oppositely disposed concave surfaces serve to deminish the abrasive action on the valve member, that would otherwise prevent it from a fluid tight seal with the valve seat when it is in the second position. Should it be desired the production valve may have only one discharge outlet, with the valve member having a single concave surface exposed to the high velocity geothermal fluid.

BRIEF DESCRIPTION OF THE DRAWINGS

FIG. 3 is a longitudinal cross sectional view of the upper portion of the assembly shown in FIG. 1;

FIG. 4 is a fragmentary longitudinal cross sectional view of a first alternate form of the first form of assembly;

FIG. 5 is a combined side elevational and longitudinal cross sectional view of a second alternate form of the first assembly;

FIG. 8 is an end elevational view of the production valve used on the first assembly to control the flow of pressurized fluid from the latter;

FIG. 9 is a longitudinal cross sectional view of the production valve taken on the line 9—9 of FIG. 8;

FIG. 10 is a longitudinal cross sectional view of a first alternate form of production valve;

FIG. 11 is a schematic drawing of a first form of system for actuating the first form of well head assembly illustrated in FIG. 1; and FIG. 12 is a schematic drawing of a second form of system for actuating the first form of assembly shown in FIG. 1.

DESCRIPTION OF THE PREFERRED EMBODIMENT

Figure 1:
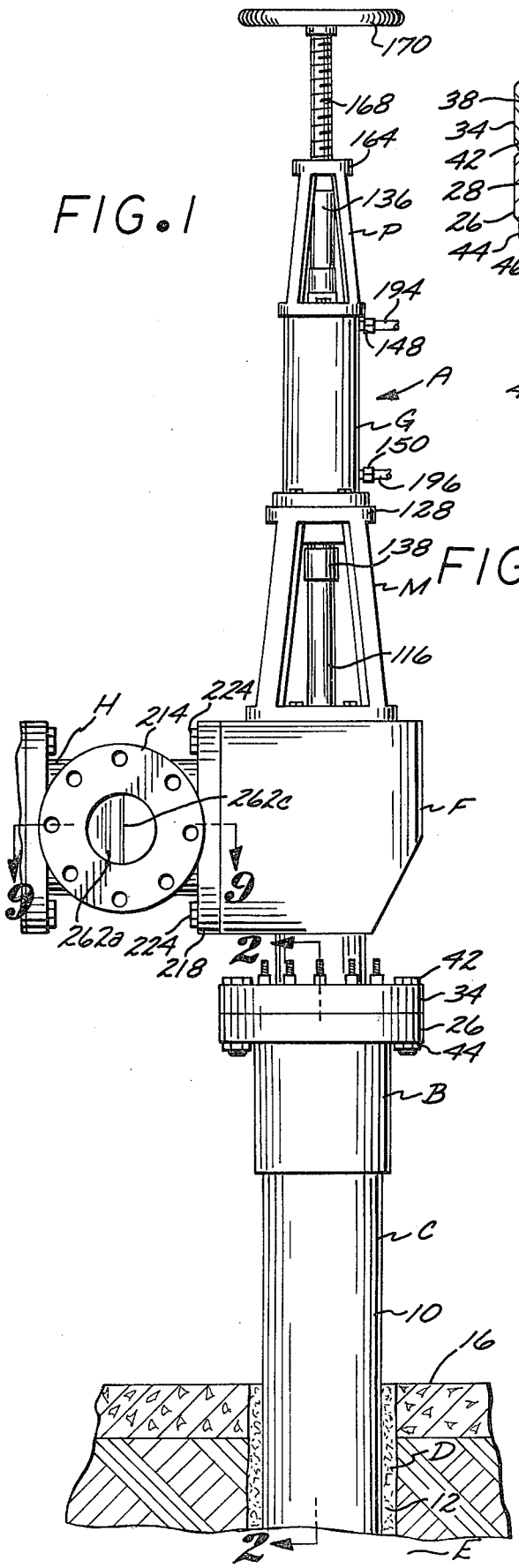
FIG. 1 is a side elevational view of a first form of geothermal well head assembly that may be operated either manually or by a pressurized fluid.
Figure 6:
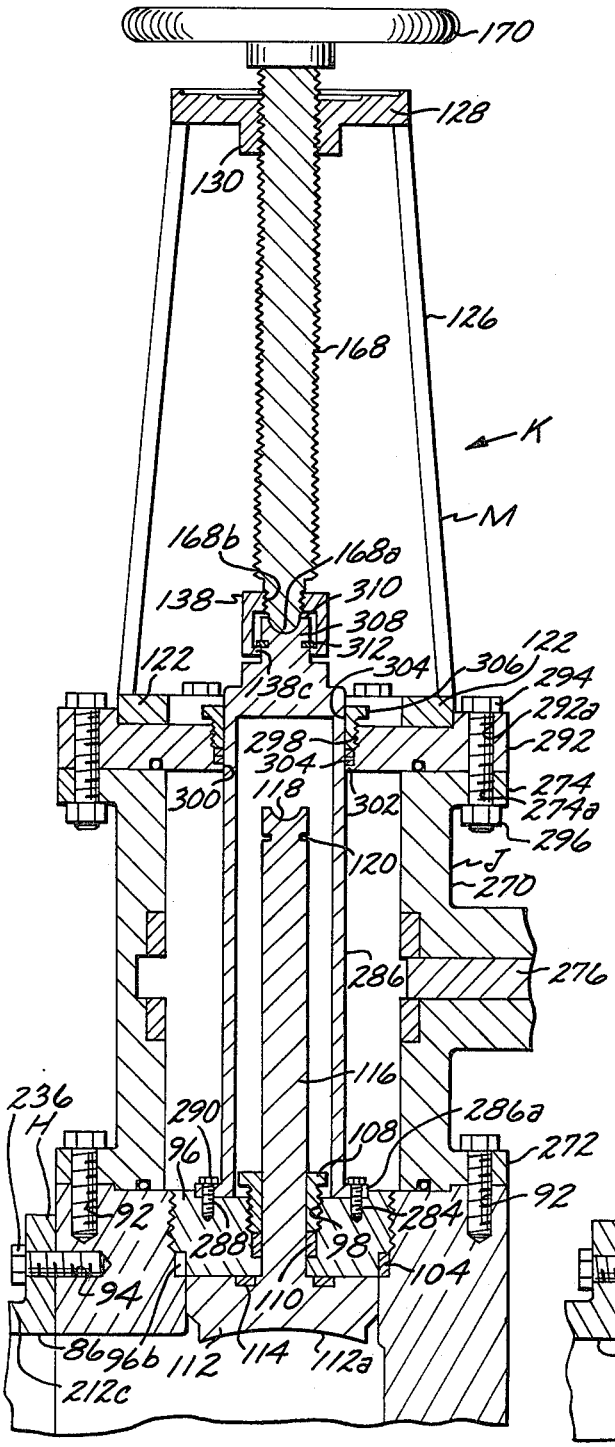
FIG. 6 is a longitudinal cross sectional view of the first form of the assembly with a gate valve mounted thereon through which a head, valve member and actuator rod may be moved upwardly by a manually operated retrieving assembly.
Figure 7:
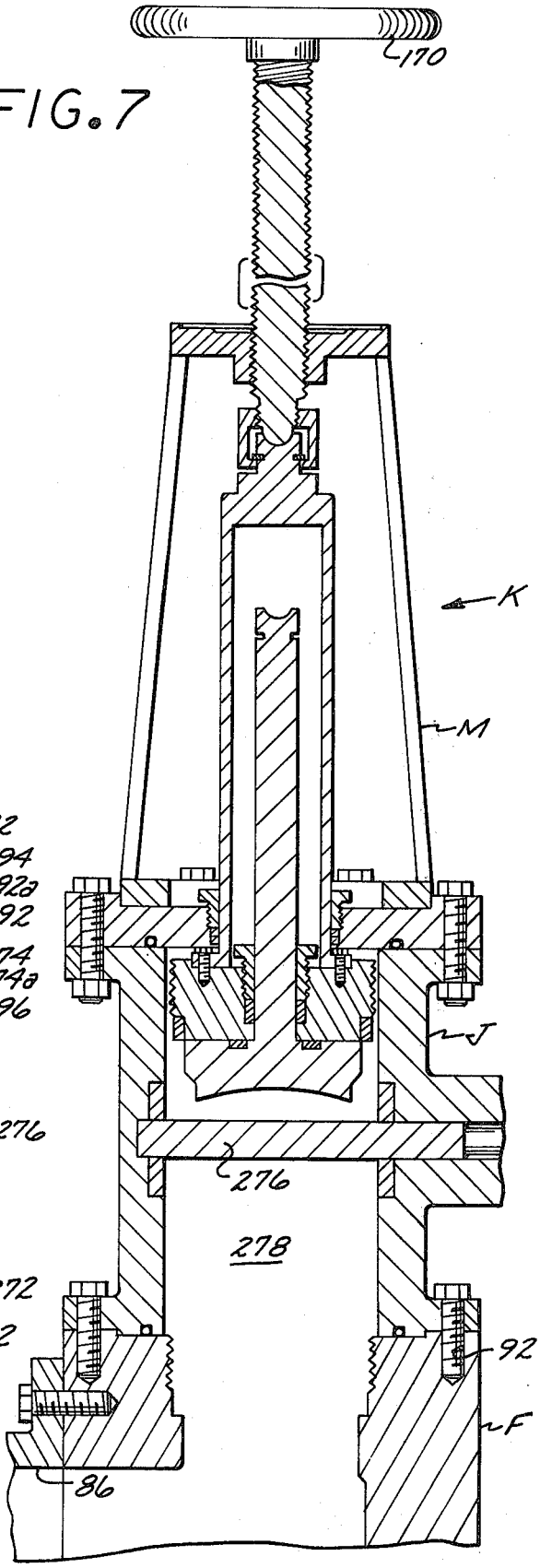
FIG. 7 is the same view shown in FIG. 6, but after the head, valve member and actuating rod have been moved upwardly above the valve plate of the gate valve.

The well head combination A of the present invention, as may best be seen in FIG. 1, includes a spool assembly B mounted on the upper end portion of a casing assembly C that extends downwardly in a well bore D, at least in part, to a geothermal zone E from which a pressurized fluid is produced. The well head A in addition includes a first valve assembly F mounted on the spool assembly B, which first valve assembly is operated by either an actuator G as shown in FIG. 1 or a first alternate form of actuator G-1 shown in FIG. 5. A second valve assembly H shown in FIGS. 1 and 9 is provided to control the flow of fluid from the first valve F. In FIGS. 6 and 7 a gate valve J is shown that is removably mounted on the upper end of the first valve F, and in cooperation with a retrieving assembly K permits the valve member of the first valve assembly F to be removed therefrom for maintenance or replacement without shutting down the geothermal well.

The casing assembly C includes a surface string of casing 10 that is encased in cement 12 in the well bore D as shown in FIG. 1. The surface string of casing 10 has an upper end 14 that is situated above the ground surface 16. A production string of casing 18 is situated within the surface string of casing 10, and extends downwardly to the geothermal zone E from which the pressurized fluid is produced. The production string of casing 18 is of smaller external diameter than the internal diameter of the surface string 10 and defines an annulus space 20 therebetween. The production string of casing 18 has a first circular collar 22 projecting outwardly from the upper end thereof as illustrated in FIG. 2.

The spool assembly B includes a cylindrical shell 24 having a lower end **24*a* and a first flange 26 extending outwardly from the upper end thereof. The first flange 26 has a number of circumferentially spaced bolt holes 28 therein, and a circular groove 30 is formed in the upper face 32 of first flange 26 as shown in FIG. 2. A second flange 34 is in abutting contact with the first flange 26 as shown in FIG. 2 with the second flange having a groove 36 and bolt holes 38 therein that are aligned with the groove and bolt holes in the first flange. A resilient ring 40 is disposed within the grooves 30 and 36. Bolts 42 extend downwardly through the bolt holes 28 and 38, and with lower ends of the bolts being engaged by nuts 44**.

Figure 2:
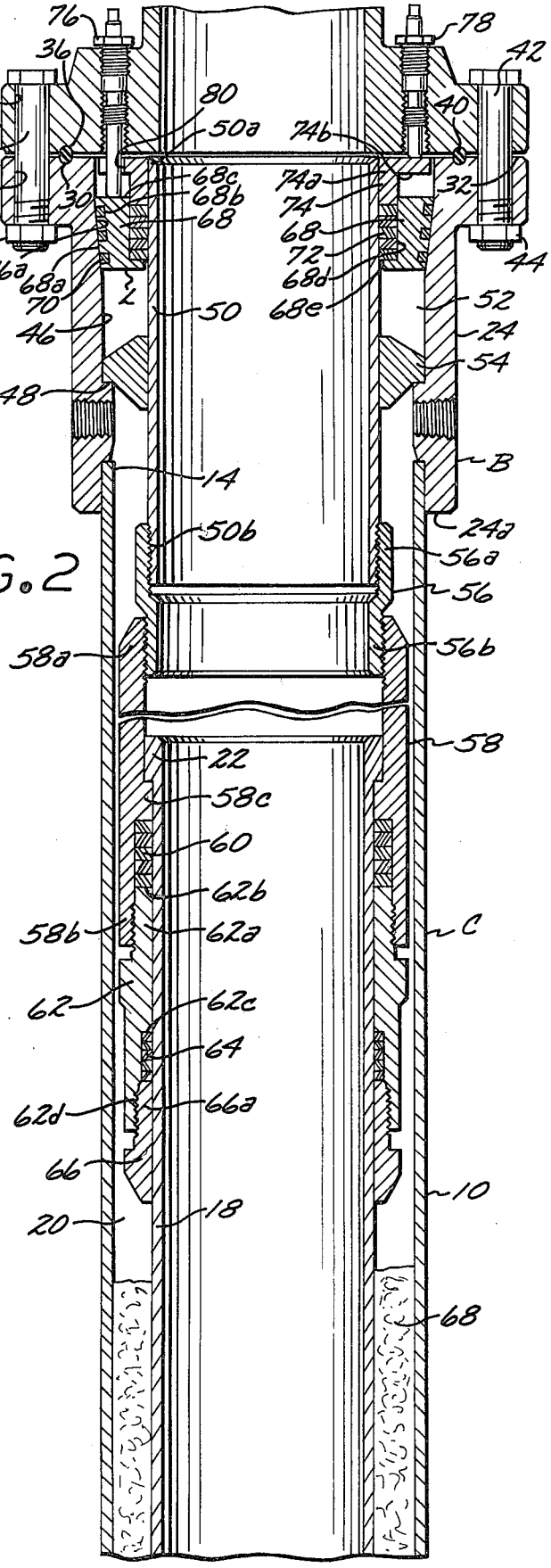
FIG. 2 is an enlarged longitudinal cross sectional view of a position of the assembly shown in FIG. 1 taken on the line 2—2 thereof.

The cylindrical shell 24 has an interior surface 46, with an upper portion **46*a* thereof tapering downwardly and inwardly as may be seen in FIG. 2. A circular abutment 48 is defined by the interior surface 46 below the tapering portion 46*a*. A tubular member 50 is provided that has an external diameter substantially less than the diameter of the interior surface 46 of the shell 24, with the tubular member 50 having an upper end 50*a* that is adjacently disposed to the second flange 34, and a lower externally threaded portion 50*b* that is illustrated in FIG. 2. The tubular member 50 and the interior surface 46 of the shell 24 cooperate to define an annulus space 52** therebetween.

In FIG. 2 it will be seen that a hanger 54 extends outwardly from the tubular member 50 and rests on the abutment 48. The lower end portion **50*b* of the tubular member 50 is situated below the lower end 24*a* of shell 24 as shown in FIG. 2. A generally cylindrical adapter 56 is provided that has an upper interior threaded portion 56*a* that engages the lower exterior threaded portion 50*b* of the tubular member 50. The adapter also includes a lower exterior threaded portion 56*b* illustrated in FIG. 2**.

The casing assembly C also includes a cylindrical upper seal holder 58 that has an upper interior threaded portion **58*a* and a lower exterior threaded portion 58*b*. The upper seal holder 58 also includes an inwardly extending circular rib 56*c* that supports the collar 22 thereon. One or more first packer rings 60 are provided that encircle the production string of casing 18 as shown in FIG. 2 and are situated below the rib 58*c*. A lower cylindrical seal holder 62 encircles the production string of casing 18, which lower seal holder has an upper externally threaded portion 62*a*, a ring shaped upper surface 62*b*, and a circular interior body shoulder 62*c* that is illustrated in FIG. 2. The upper exterior threaded portion 62*a* of the lower seal holder 62 engages the lower exterior threaded portion 58*b* of the upper seal holder 58. When the upper seal holder 58 is rotated relative to the lower seal holder 62, the first packer rings 60 are compressed and forced into slidable sealing contact with the exterior surface of the production string of casing 18**.

One or more second packer rings 64 encircles the production string of casing 18 as may be seen in FIG. 2. A cylindrical lower seal packer 66 is also provided in FIG. 2 that encircles the production string of casing 18, with the lower seal packer including an upper externally threaded portion **66*a* that engages with lower interior threaded portion 62*d* of the lower cylindrical seal holder 62. When the lower seal holder 62 and seal packer 66 are rotated relative to one another, the second packer rings 64 are compressed and forced into slidable sealing contact with the exterior surface of the production casing 18**.

The production string of casing 18 is preferably supported for a substantial period of time, such as twenty-four hours, by the first collar 22 from the rib **58*c*, and during this time the production string of casing 18 is heated from the geothermal zone E to expand longitudinally to substantially a maximum length. After the production string of casing 18 has so expanded longitudinally, cement 68 is placed in the annular space 20, and extends upwardly therein to a position adjacent the lower seal packer 66. When the above procedure is followed, variations in temperature will have a minimum effect on the production string of casing 18 moving relative to the cement 68. It will be seen in FIG. 2 that longitudinal movement of the production string of casing 18 may take place without the seal between it and the first packer rings 60 and second packer rings 64** being disrupted.

The seal assembly L as shown in FIG. 2 effects a seal between the interior surface of the spool B and the exterior surface of the tubular member 50. The seal combination L includes a first rigid ring 68 that has an outer tapered face 68 that is of substantially the same angulation as that of the tapered surface **46*a* of spool B. The tapered face 68*a* has a number of spaced recesses 68*b* extending inwardly therefrom in which first sealing rings 70 are disposed, with the first sealing rings extending outwardly from the recesses 68*b* a sufficient distance as to be compressed when in contact with the surface 46*a*. The first ring 68 includes a flat upper surface 68*c*, an interior cylindrical surface 68*d* that is radially spaced from the exterior surface to the tubular member 50, and a circular abutment 68*a* that extends inwardly. Second sealing rings 72 encircle the tubular member 50 as shown in FIG. 2 and are disposed in an annulus space defined by the lower circular abutment 68*e* and the cylindrical first surface 68*d*. A second rigid ring 74 is mounted in the annulus space 52 above the first ring 68 as may be seen in FIG. 2. The second ring 74 is defined by a first vertically extending leg 74*a*, which leg has a lower end thereof in engagement with the upper most one of the second sealing rings 72. The first vertical leg 74*a* has a second horizontal leg 74*b*** extending outwardly from the upper portion thereof as shown in FIG. 2, which second leg is situated within the annulus space 52.

The second flange 34 threadedly supports a number of first elongate member 76 and second elongate member 78 that are circumferentially spaced with one another, with the first members extending downwardly through bores 80 formed in the second leg 74*b* as shown in FIG. 2. By rotating the first member 76 they may be moved downwardly relative to the second flange 34, with the lower ends of the members being in contact with the upper surface 68*c* of the first ring 68, and moving the latter downwardly to force the first sealing ring 70 into pressure sealing contact with the surface 46*a*. By rotating the second members 78 in an appropriate direction, the lower ends thereof exert a downward force on the second horizontal leg 74*b*, to force the member 74 downwardly, and compress the second sealing ring 72 into sealing engagement with the exterior surface of the tubular member 50. From the above description it will be seen that the first and second sealing rings 70 and 72 may be periodically subjected to increased pressure to maintain them in sealing contact with the tapered surface 46*a* and the external surface of the tubular member 50.

Second flange 34 is a part of first valve assembly F, and has a tubular neck 80 extending upwardly therefrom, which neck develops into a first valve body 82. First valve body 82 has a vertical passage 84 extending upwardly therein from the neck 80, with the passage defining a circular body shoulder 84*a*, and having an internally threaded portion 84*b* situated above the body shoulder. First valve body 82 has a horizontal upper end 82*a*, and first and second side walls 82*b* and 82*c* as may be seen in FIG. 3.

Valve body 82 has a transverse passage 86 extending inwardly from the first side wall 82*b* thereof, which transverse passage intersects the vertical passage 84. An interior portion of the valve body 82 below the transverse passage 86 is recessed and removably supports a valve seat 88 as shown in FIG. 3.

A number of circumferentially spaced first and second tapped recesses 90 and 92 extend downwardly from the upper end 82*a* of the first valve body 80 as shown in FIG. 3. Also, a number of circumferentially spaced tapped recesses 94 extend inwardly from the first side wall 82*b* of the first valve body. The first valve assembly F includes a cylindrical head 96 that has threads 96*a* on the side wall thereof. In addition, a circular body shoulder 96*b* is defined on the side wall of the head below the threads. Head 96 has a flat upper surface 96*c*. A centered tapped bore 98 extends downwardly in head 96 from the flat upper surface thereof and defines a circular body shoulder 100 at the intersection with a counter bore 102 as shown in FIG. 3. A sealing ring 104 rests on body shoulder 84*a* and is compressed between it and body shoulder 96*b* when head 96 is screwed into first valve body 82 as shown in FIG. 3.

An externally threaded bushing 108 engages tapped bore 98. The bushing 108 has a longitudinal bore 108*a* therein. A sealing ring 110 rests on body shoulder 100.

A cylindrical valve member 112 is provided that is longitudinally movable in passage 84. The valve member 112 has a lower concave face 112*a*, and a circular tapered surface 112*b* that may sealingly abut against a like tapered surface 88*a* of valve seat 88 when the valve member is in a first position. Valve member 112 has an upper surface on which a resilient ring 114 is supported that seals with the lower surface of heat 96 when the valve member moves upwardly the maximum extent possible to a second position as shown in FIG. 3 where it is situated above transverse passage 86. An actuator rod 116 extends upwardly from valve member 120 through bore 108*a* in bushing 108, and has a sealing ring 110 in sealing contact therewith when bushing 108 is rotated to compress the sealing ring between the lower end of the bushing and the body shoulder 100. The actuator rod 116 is illustrated in FIG. 3 as having a concave upper end 118 and a circumferentially extending groove 120 therebelow.

The actuator assembly G as may best be seen in FIG. 3 includes a first tripod M that has a ring shaped base 122 in which a number of circumferentially spaced transverse bolt holes 122*a* are defined through which bolts 124 extend downwardly to engage the tapped recesses 90, and support the tripod M in a fixed position on the upper end of the first valve body 82. In FIG. 3 it will be seen that a number of spaced legs 126 extend upwardly and inwardly from the ring shaped base 122, and the leg supporting a horizontal plate 128 on the upper end thereof.

The plate 128 includes a centered downwardly extending boss 130 that is internally threaded and is removably engaged by an externally threaded bushing 132. The bushing 132 has a vertical bore 134 therein that is slidably engaged by a piston rod 136. The piston rod 136 has threads 136*a* formed on the lower end thereof, and the piston rod below the threads terminating in a convex lower end 136*b* as shown in FIG. 3. A first engageable member 138 is provided that includes a cylindrical shell 138*a* that has threads 138*b* formed on the upper interior portion thereof as may be seen in FIG. 5 as well as in FIG. 3, and the shell also including a lower circular inwardly extending lip 138*c*. The groove 120 on actuator rod 116 removably supports a snap ring 120*a*. When the piston rod 136 is rotated in an appropriate direction to cause the threads 136*a* to engage threads 138*b*, the engageable member 138 is moved upwardly to force the lip 138*c* into contact with snap ring 120*a*, and the convex lower end 136*b* of piston rod 136 being forced into contact with the concave end surface 118 as shown in FIG. 3. The actuator rod 116 is now removably secured to the piston rod 136. The piston rod 136 in the actuator G may be moved vertically either by pressurized fluid, or by manual operation as hereinafter explained.

The actuator G as may be seen in FIG. 3 includes a vertically disposed hydraulic cylinder N that is defined by a cylindrical shell 140 that has an outwardly flanged lower end 140*a*, and a closed upper end 140*b* in which a centered transverse bore 140*c* is defined. The lower interior end portion of the cylindrical shell 140 has threads 140*d* formed thereon, which threads are engaged by an externally threaded end piece 142. The end piece 142 has a transverse bore 142*a* formed therein, as well as internal recesses that extend upwardly from the bore, with the recesses 142*b* serving to support sealing rings 144 that are in slidable sealing contact with the piston rod 136.

The hydraulic cylinder above described has an interior confined space 146 that is in communication with an upper tubular fitting 148 and lower tubular fitting 150 as shown in FIG. 3. A piston 152 is slidable disposed within the cylindrical shell 140, which piston has a centered internally threaded bore 152*a* that engages threads 136*c* on the piston rod 136 as shown in FIG. 3. The exterior cylindrical surface of the piston 152 supports a number of sealing rings 154 that are in slidable sealing contact with the interior cylindrical surface of the shell 140.

A second tripod P as may best be seen in FIG. 3 is removably mounted on the upper end 140*b* of the hydraulic cylinder N. The second tripod P includes a ring shaped base 156 that has a number of spaced bolt holes not shown defined therein through which bolts 158 extend downwardly to removably engage tapped recesses 160 formed in the upper end 140*b*.

The second tripod P includes a number of circumferentially spaced legs 162 that extend upwardly from the ring shaped base 156 to support a horizontal plate 164 on the upper end thereof. The plate 164 has a centered downwardly extending boss 164*a* in which an internally threaded vertically disposed bore 166 is defined. The internally threaded bore 166 is rotatably engaged by a threaded rod 168 that may be rotated manually by a hand wheel 170 as shown in FIG. 5. The rod 168 has a convex lower end 168*a* that may be disposed in abutting contact with a concave end surface 136*d* of the piston rod 136.

The piston rod 136 adjacent the concave end 136*d* has a transverse circumferentially extending groove defined therein in which a snap ring 172 is disposed. A second engageable member 138 is provided that encircles the piston rod 136 as shown in FIG. 3 and normally rests in a position on the upper end 140*b* of the hydraulic cylinder N. Should there be a failure of pressurized fluid to operate the hydraulic cylinder N, the second engageable member 138 may be manually moved upwardly to engage the snap ring 172 adjacent the concave end 136*d* of piston rod 136, and the threaded rod rotated to engage the threads 138*b* in the engageable member.

Such rotation of the threaded rod 168 will cause the second engageable member to move upwardly thereon, with the convex end 168*a* of the threaded rod being forced into pressure contact with end 136*d* of the piston rod as the tip 138*c* is forced into contact with the snap ring 172. Rotation of the hand wheel 170 causes the threaded rod 168 to move upwardly or downwardly relative to plate 164, and this movement being imparted to the piston rod 136, and in turn to the actuator rod 116. Such movement of the actuator rod 116 may be utilized to move the valve member 112 to either the first or second position.

The actuator G shown in FIG. 3 may be operated by either a first pressurized fluid system R illustrated diagrammatically in FIG. 11 or a second pressurized fluid system S shown in FIG. 12. The system R includes a valve 174 that has a rotatable member 176 as a part thereof in which a first passage 178 is defined, and a second passage 180. The valve included first, second, third, and fourth ports 181, 181*a*, 181*b* and 181*c*. System R also includes a liquid resevoir 182 that has a conduit 184 extending therefrom to a filter 186, which filter is connected by a conduit 188 to the section side 190*a* of a power driven pump 190.

The pump 190 has the discharge side 190*b* thereof connected by a conduit 192 to first port 181. Second port 181*a* is connected by a conduit 194 to the first fitting 148 on the hydraulic cylinder N. The second fitting 150 on the hydraulic cylinder N is connected by a conduit 196 to the fourth port 181*c*.

The third port 181*b* of valve 174 is connected by a conduit 198 to the resevoir 182. When the valve 174 is in the first position as shown in FIG. 11 the pump 190 will discharge liquid from the resevoir into the upper portion of the hydraulic cylinder N to move the piston rod 136 and the valve member 112 of first valve F downwardly from the second position shown in FIG. 3 to a first position where it is engagement with the valve seat 88 to obstruct discharge of geothermal fluid from the production string of casing 18. By rotating the valve member 176 ninety degrees clockwise, the flow of fluid to the hydraulic cylinder N is reversed, and the actuator rod is moved upwardly to move the valve member 112 from the first position to the second position shown in FIG. 3 where it is disposed above the transverse passage 86.

In the second system S illustrated in FIG. 10 the same valve 174 is used, and is connected to the hydraulic cylinder N by conduits 194 and 196 as previously described. In the system S pressurized gas is utilized as the motive force and is discharged from a cylinder 200 of nitrogen or the like to a valve 202, which valve has a conduit 204 extending therefrom to a pressure regulator 206. The pressure regulator 206 has a conduit 208 extending therefrom to the first port 181. When the valve 174 is in the first position shown in FIG. 12 air or gas below piston 152 will discharge through the conduit 196 and second passage 180 to vent to the atmosphere through a conduit 210. From the previous description, it may be seen that the first valve F may have the valve member 112 therein moved between a first and second position by utilizing the pressurized fluid portion of the actuator G, or by use of the manually operated part of the actuator as previously mentioned.

When it is desired to remove the valve member 112 from the first valve body F for replacement or repair without shutting down the geothermal well, the valve member is moved to the uppermost position above the transverse passage 86 as shown in FIG. 6. The actuator G is now removed from the first valve body F.

A gate valve J is provided of a structure that includes an elongate tubular body 270 that has first and second flanges 272 and 274 on the ends thereof. A valve plate 276 is included as a part of the valve J that may be moved from a first position shown in FIG. 6 to a second position illustrated in FIG. 7 to obstruct the elongate passage 270 in the valve body.

First flange 272 rests on the upper end 82*a* of first valve body 82, with the flange having a number of bolt holes 280 therein that are aligned with tapped recesses 92. Bolts 282 extend downwardly through the bolt holes to engage the tapped recesses and secure the gate valve J to the first valve body F. Head 96 has a number of circumferentially spaced tapped recesses 284 extending downwardly from the top surface thereof.

An elongate tubular retrieving member 286 is provided that has a lower open end from which a flange 286*a* extends outwardly that has a number of spaced bolt holes 288 therein that are aligned with tapped recesses 284. Bolts 290 are extended downwardly through holes 288 to engage tapped recesses 284, and removably secure tubular member 286 to head 96.

A working plate 292 rests on second flange 274. Plate 292 and second flange 274 have aligned bolt holes 292*a* and 274*a* therein through which bolts 294 extend downwardly to engage nuts 296. Working plate 292 has a centered tapped bore 298 therein which at a junction with a counter bore 300 defines a circular body shoulder 302 on which a resilient ring 304 rests. In FIG. 6 it will be seen that retrieving member 286 extends upwardly through counter bore 302 and a bore 304 in an externally threaded bushing 306 that engages tapped bore 298. When bushing 306 is screwed downwardly in tapped bore 298 resilient ring 304 is compressed into sealing contact with retrieving member 286.

Retrieving member 286 has a closed upper end from which a cylindrical neck 308 extends upwardly to terminate in a concave end surface 310. Neck 308 has a circumferentially extending groove therein (not shown) in which a snap ring 312 is disposed.

Second threads 168*b* are formed on threaded rod 168 adjacent the convex end 168*a*. Second threads 168*b* engage an engageable member 138 as previously described. The threaded rod rotatably engages the interior threaded boss 130.

When threaded rod 168 is rotated by hand wheel 170 the second threads 168*b* rotate relative to threads in engageable member 138 with end 168*a* being forced into pressure contact with concave end 310 and lip 138*c* into forceful contact with snap ring 312. After such forceful contact is made further rotation of threaded rod 168 relative to internally threaded bushing 130 results in the head 96 being unscrewed from valve body F and concurrently be raised upwardly until it and valve member 112 are disposed in the upper porton of the gate valve J above valve plate 276. The valve plate 276 is now moved to the sealing position shown in FIG. 7. The working plate 292 and head 29, valve member 112 and actuator rod 116 may now be separated from gate valve J by disengaging bolts 294 from nuts 296. The valve member 112 may now be repaired or replaced.

The valve member 112 may now be replaced in an operative position in valve body F by reversing the procedure above described. In FIG. 4 an alternate valve body F-1 is shown that has oppositely disposed transverse passages 86 defined therein, and which structure permits two of the second valves H to be used to control the flow of pressurized geothermal fluid from the first valve F.

When the assembly F is in the position shown in FIG. 1 control of the flow of fluid may be regulated either by a second valve assembly H shown in FIGS. 8 and 9 or an alternate form of second valve assembly H-1 illustrated in FIG. 10.

The second valve assembly H as shown in FIG. 9 has a tubular valve body 212 of cross shape that includes first, second, third and fourth legs 212*a*, 212*b*, 212*c* and 212*d*. First and second legs 212*a* and 212*b* develop into first and second conventional flanges 214 and 216 that may be connected to flanged tubular conduits (not shown) that conduct the geothermal fluid to a desired destination.

The third leg 212*c* develops into a third flange 218 that has a number of circumferentially spaced transverse holes 222 therein through which bolts 224 extend to engage the tapped recesses 94 in assembly F, and support second assembly H from first assembly F. A recessed valve seat 226 is defined on the inner end of the third leg 212*c*.

Fourth leg 212*c* defines an outer ring shaped flat end surface 228 that has a number of circumferentially spaced tapped recesses 230 extending inwardly therefrom. A heavy plate 232 abuts against end surface 228 and is removably held in position thereon by bolts 236 that extend through transverse openings 234 in the plate to engage the tapped recesses 230.

Plate 232 has a centered transverse threaded bore 236 that effects a circular body shoulder 238 with a threaded counter bore 240. A sealing ring 242 rests on body shoulder 238 and is contacted by the inner end of a tubular bushing 244 that has external threads 233 that engage the threaded bore 236. A rigid ring 248 as shown in FIG. 9 is secured to plate 232 by conventional means (not shown). Ring 248 supports a tripod 246 that has a number of outwardly and inwardly extending legs 250 to support a hydraulic cylinder 252 from the outer ends thereof as shown in FIG. 9.

Hydraulic cylinder 252 has tubular connections 254 and 256 on the end portions thereof. A piston 258 is slidably mounted in cylinder 252 and is connected to a piston rod 260 that extends through bushing 244 into the interior of valve body 212. A circular valve member 262 is secured to the inner end of piston rod 258 as shown in FIG. 9 and disposed within valve body 212. Valve member 262 on the inner end defines first and second concave faces 262*a* and 262*b* that merge at a diametrical edge 262*c*. When second valve assembly H is disposed as shown in FIG. 9, geothermal fluid flowing into second assembly H impacts on concave faces 262*a* and 262*b* and is deflected in substantial equal amounts into first and second tubular legs 212*a* and 212*b*. The valve member 262 is of such size and configuration to seal with valve seat 226 when moved into pressure contact therewith. By tightening the bushing 244 the resilient ring 242 is deformed into slidable sealing contact with piston rod 260. Operation of first production valve H is achieved by discharging pressurized fluid into one of the connections 254 or 256 and allowing fluid in cylinder 252 to flow through the other thereof.

A single second valve assembly H may be used on first assembly F as shown in FIG. 3, or two of the second valve assemblies H may be secured to an alternate form of first valve assembly F-1, which alternate form is illustrated in FIG. 4.

An alternate form H-1 of the second valve assembly is illustrated in FIG. 10 that is identical with the second assembly H other than second leg 212*b* is eliminated from valve body 212 and replaced with a wall 264, and valve member 262 has a single concave face 262*d* rather than two concave faces 262*a* and 262*b*. All geothermal fluid entering the second valve assembly H-1 will discharge through the first tubular leg 212*a*.

The use and operation of the invention has been explained previously in detail and need not be repeated.

What is claimed is:

1. In combination with a pressurized fluid producing geothermal well that has a surface string of casing cemented in the bore thereof, a production string of casing that extends downwardly through said surface string of casing to communicate with a pressurized fluid producing geothermal zone, both of said strings of casing having upper ends, a well head assembly mounted on said upper end of surface string of casing and so maintaining said production string of casing in said well that when at least a portion of said production string of casing is anchored to a lower portion of said surface string of casing said production string of casing can expand and contract longitudinally due to variations in temperature without placing any substantial additional strain on said well head assembly, said well head assembly capable of having interior components thereof subjected to wear removed therefrom for repair or replacement without shutting down said geothermal well, said production string of casing having engageable means on said upper end thereof, said well head assembly including:

a. a vertically disposed tubular spool that has upper and lower ends and an abutment on the interior thereof, said lower end of said spool secured to said upper end of said surface string of casing;

b. a vertical tubular member that has upper and lower ends and is positioned at least partially in said spool;

c. hanger means secured to said tubular member that extend outwardly therefrom and rest on said abutment;

d. tubular means secured to said lower end of said tubular member that extend downwardly and sealingly over said upper end of production string of casing, said tubular means including engaging means on the interior thereof on which said engageable means rest to support said production string prior to the latter being anchored to said surface string of casing, with said production string of casing after being anchored capable of expanding and contracting longitudinally due to variations in temperature by said engageable means moving vertically relative to said engaging means;

e. a first valve assembly that includes a first valve body that has top, bottom and first and second side surfaces, an externally threaded head that removably engages a threaded upper portion of a first passage that is vertical and extends downwardly from said top to said bottom surface, said vertical passage defining a valve seat, a second passage that is horizontal and extends from said first passage above said valve seat through said first sidewall, a valve member slidably mounted in said first passage that can occupy either a first position where it seals with said valve seat or a second position where it is disposed above said second passage adjacent said head, said valve member of no greater diameter than said head, an externally threaded bushing that removably engages a centered tapped bore in said head, and an elongate actuator rod that extends upwardly from said valve member through said bushing, said actuator rod having an upper end;

f. a second valve assembly secured to said first sidewall of said first valve body for controlling the flow of said pressurized fluid from said well head assembly when said first valve member is in said second position;

g. an actuator assembly removably secured to said upper surface of said first valve body that removably engages said upper end of said actuator rod and moves the latter vertically to dispose said first valve member in either said first or second position;

h. an elongate inverted cup shaped member that removably but non-rotatably engages the upper surface of said head to envelop said actuator rod when said first valve member is in said second position and said actuator assembly has been removed from said first valve body;

i. a gate valve that has an elongate body that has first and second ends between which a third passage extends that has a diameter greater than that of said head, a transverse valve plate slidably supported in said gate valve body that may be moved from a first position where it is clear of said third passage to a second position where it obstructs said third passage in said gate valve body, said gate valve including means for removably securing said first end to said top surface of said first valve body;

j. a working plate removably securable to said second end of said gate valve body, said working plate having a centered opening therein through which said elongate cup shaped member extends upwardly;

k. a retrieving assembly removably mounted on said working plate for removably engaging said elongate cup shaped member to rotate the latter and unscrew said head from said first valve body and thereafter move said head, first valve member, and actuator rod upwardly until said first valve member is above said valve plate, said valve plate then being moved to said second position, whereupon said working plate may be removed from said gate valve body for said first valve member to be repaired or replaced, and said head, valve member, and actuator rod being returned to an operative position in said first valve body by reversing the procedure above described.

2. A well head assembly as defined in claim 1 in which said lower end of said tubular member is threaded and said tubular means includes:

l. a tubular adapter that has upper and lower threaded ends, said upper threaded end of said adapter engaging said lower threaded end of said tubular member;

m. a tubular upper seal holder that has an upper threaded end that engages said lower threaded end of said adapter, said upper seal holder having an internally threaded lower end portion, said engaging means being a circular rib that extends inwardly from the interior of said upper seal holder, said engageable means being a circular outwardly extending collar on said upper end of said production string of casing that rests on said circular rib prior to said production string having at least the lower portion thereof anchored to said surface string of casing, and said collar being disposed a sufficient distance below said adapter that said collar will not contact the latter when said production string of casing expands longitudinally;

n. first circular resilient packer means that encircle said production string of casing directly below said rib;

o. a lower tubular seal holder that envelops a section of said production string of casing, said lower seal holder having an upper ring shaped end and an externally threaded upper end portion there below that engages said interior threaded end portion of said upper seal holder, said upper and lower seal holders when rotated in an appropriate direction relative to one another compressing said first circular resilient packer means between said upper ring shaped end and said rib to deform said circular resilient packer means radially into slidable pressure sealing contact with the exterior surface of said production string of casing.

3. A well head assembly as defined in claim 2 in which said lower seal holder has an internally threaded lower end portion and a circular interior abutment thereabove, and said well head assembly in addition including:

p. second circular resilient packer means that encircle said production string of casing directly below said circular abutment;

q. a lower tubular packer that encircles said production string of casing and has an externally threaded upper portion that engages said lower internally threaded portion of said lower tubular seal holder, with said lower tubular packer when rotated in an appropriate direction compressing said second circular resilient packer between said abutment and lower tubular packer to deform said second circular resilient packer radially into slidable pressure sealing contact with the exterior surface of said production string of casing.

4. A well head assembly as defined in claim 1 in which said first valve member has an arcuate shaped lower end surface for deflecting said pressurized fluid flowing upwardly in said first passage of said valve body into said second passage to minimize wear on said first valve member.

5. A well head assembly as defined in claim 1 in which there is a longitudinally extending annulus space between said surface string of casing and said production string of casing, and at least the lower portion of said annulus space filled with cement to anchor said production string of casing to said surface string of casing.

6. A well head assembly as defined in claim 1 which in addition includes:

l. compressed sealing means between the interior of said spool and the exterior surface of said tubular member; and m. rotatable means that permits the degree of compression on said sealing means to be varied from the exterior of said spool.

7. A well head assembly as defined in claim 1 in which said second valve assembly includes:

l. a second valve body in the form of a tubular cross that has first and second axially aligned oppositely extending legs through which said pressurized fluid may discharge, third and fourth axially aligned oppositely extending legs in communication with said first and second legs; a valve seat defined in said third leg at the junction of the latter with said first and second legs; means for removably securing said third leg to said first side surface of said valve body with said second passage in said first valve body in communication with the interior of said third leg; a plate removably secured to said fourth leg, said plate having a tapped centered bore therein; an externally threaded tubular bushing and resilient sealing ring mounted in said tapped bore of said plate; a rod slidably mounted in said bushing in said plate and sealing engaging said sealing ring; said rod having first and second ends; a second valve member disposed within said second valve body and secured to said first end of said rod, said second valve member capable of being moved by said rod between a first position where it seals with said valve seat in said second valve body and a second position where it is adjacent said plate secured to said fourth leg, said second valve member having a first surface on which said pressurized fluid flowing into said second valve body impinges, and said first surface having two oppositely extending concave sections that deflect said pressurized fluid to said first and second tubular legs; and m. power operated actuating means removably secured to said plate on said fourth leg and removably connected to said second end of said rod for selectively moving said rod to dispose said second valve member in either said first or second position or an intermediate position therebetween to control the flow of said pressurized fluid from said second valve assembly, and said power operated means capable upon the failure thereof to be removed from said plate to permit said rod to be manually operated to dispose said second valve member in said first position.

8. A well head assembly as defined in claim 1 in which said actuator assembly includes:

l. a horizontal plate having a centered transverse tapped bore therein;

m. a vertical rod that has upper and lower ends, said rod having first external threads thereon, and second external threads below said first external threads and adjacent said lower end, said first external threads engaging said tapped bore in said plate;

n. handle means on said upper end of said rod for manually rotating the same to move said vertical rod upwardly and downwardly relative to said plate;

o. supporting means for removably maintaining said horizontal plate a fixed distance above said upper surface of said first valve body;

p. a resilient snap ring mounted in a transverse circumferential groove in said actuator rod adjacent said upper end thereof;

q. an engageable member that includes a cylindrical shell having a closed upper end in which a centered tapped bore is defined that may be engaged by said second threads, and a circular lip that extends inwardly from said lower end of said shell under said snap ring, with said vertical rod when initially rotated causing said second threads to engage said tapped bore in said closed end to force said circular lip into pressure engagement with said snap ring and said lower end of said vertical rod into frictional pressure contact with said actuator rod and further rotation of said vertical rod causing selective vertical movement of said actuator rod to move said first valve member to either said first or second position.

9. A well head assembly as defined in claim 8 in which said lower end of said vertical rod is convex and said upper end of said actuator rod is concave.

10. A well head assembly as defined in claim 1 in which said transverse horizontal passage in said first valve body extends through both said first and second sidewalls, and in addition;

l. another second valve assembly removably secured to said second sidewall of said first valve body for controlling the flow of said pressurized geothermal fluid flowing through said transverse horizontal passage in said first valve thereto.

11. A well head assembly as defined in claim 1 in which said actuator assembly includes:

l. power operated means removably mounted on said upper surface of said first valve body that removably engage said upper end of said actuator rod to move the latter vertically when said power operated means is energized to dispose said first valve member in either said first or second position; and m. manually operated means removably mounted on said power operated means for operating the latter when it is not energized to permit said first valve member to be moved to either said first or second position should said power operated means be inoperative.

12. A well head assembly as defined in claim 11 in which said power operated means includes:

n. a vertically disposed cylindrical shell that has upper and lower closed ends;

o. an elongate vertical piston rod that has upper and lower ends and an intermediate portion therebetween, said intermediate portion slidably supported in vertically aligned seal defining opening in said upper and lower closed ends of said cylindrical shell;

p. a piston slidably and sealingly movable in said cylindrical shell and secured to said intermediate portion of said piston rod, with said lower end of said piston rod below and said upper end of said piston rod above said cylindrical shell;

q. first means for removably supporting said shell at a fixed distance above said upper surface of said first valve body;

r. second means for removably connecting said lower end of said piston rod to said upper end of said actuator rod;

s. a source of pressurized fluid;

t. valved conduit means in communication with said source of pressurized fluid and the interior of said shell above and below said piston therein, said valved conduit means capable of being manipulated to concurrently discharge said pressurized fluid into and out of the interior of said cylindrical shell to move said piston, actuator rod and first valve member to dispose the latter in either said first or second position; and u. third means for removably connecting said upper end of said piston rod to said manually operated means to permit the latter to concurrently move said piston rod, piston, actuator rod and first valve member should there be a failure at said source of pressurized fluid or should said power operated means malfunction.

13. A well head assembly as defined in claim 12 in which said manually operated means includes:

v. a horizontal plate having a centered tapped bore therein;

w. a vertical externally threaded rod in engagement with said tapped bore, said externally threaded rod having an upper and lower end;

x. third means for supporting said plate at a fixed elevation above said cylindrical shell;

y. handle means secured to said upper end of said externally threaded rod for rotating the same and moving said rod longitudinally relative to said plate; and z. fourth means for removably connecting said lower end of said threaded rod to said upper end of said piston rod.

14. A well head assembly as defined in claim 12 in which said pressurized fluid is a compressed inert gas.

15. A well head assembly as defined in claim 12 in which said pressurized fluid is a liquid, and said valved conduit means is a closed system that includes a power driven pump for discharging said liquid under pressure to the interior of said shell, a resevoir for receiving said liquid from said shell, and said power driven pump having the suction side thereof connected to said reservoir.

* * * * *